US005397761A

United States Patent [19]

Takiguchi et al.

[11] Patent Number: 5,397,761

[45] Date of Patent: Mar. 14, 1995

[54] HEAT TRANSFER IMAGE-RECEIVING SHEET

[75] Inventors: Ryohei Takiguchi; Yoshinori Nakamura; Noritaka Egashira, all of Tokyo, Japan

[73] Assignee: Dai Nippon Insatsu Kabushiki Kaisha, Japan

[21] Appl. No.: 91,723

[22] Filed: Jul. 15, 1993

Related U.S. Application Data

[63] Continuation of Ser. No. 670,428, Mar. 18, 1991, abandoned.

[30] Foreign Application Priority Data

Mar. 23, 1990 [JP] Japan ..... 2-74767

[51] Int. Cl.[6] ..... B41M 5/035; B41M 5/38

[52] U.S. Cl. ..... 503/227; 428/195; 428/500; 428/522; 428/913; 428/914

[58] Field of Search ..... 8/471; 428/195, 500, 428/913, 914, 522; 503/227

[56] References Cited

U.S. PATENT DOCUMENTS 5,021,671 6/1991 Kohda ..... 250/484.1

FOREIGN PATENT DOCUMENTS

| | | | |
|---|---|---|---|
| 0209359 | 1/1987 | European Pat. Off. | 503/227 |
| 59-178293 | 10/1984 | Japan | 503/227 |
| 59-182785 | 10/1984 | Japan | 503/227 |
| 59-196292 | 11/1984 | Japan | 503/227 |
| 60-101090 | 6/1985 | Japan | 503/227 |
| 61-54981 | 3/1986 | Japan | 503/227 |
| 61-54982 | 3/1986 | Japan | 503/227 |
| 61-229594 | 10/1986 | Japan | 503/227 |
| 62-73969 | 5/1987 | Japan | 503/227 |
| 62-214990 | 9/1987 | Japan | 503/227 |
| 63-145089 | 6/1988 | Japan | 503/227 |
| 64-42284 | 2/1989 | Japan | 503/227 |
| 1-171887 | 7/1989 | Japan | 503/227 |
| 1-204788 | 8/1989 | Japan | 503/227 |
| 1-225586 | 9/1989 | Japan | 503/227 |
| 2-47096 | 2/1990 | Japan | 503/227 |

*Primary Examiner*—B. Hamilton Hess

*Attorney, Agent, or Firm*—Parkhurst, Wendel & Rossi

[57] ABSTRACT

A heat transfer image-receiving sheet including (i) a substrate sheet, and (ii) a dye-receiving layer including an ultraviolet-absorbing agent having a melting point of from 50° C. to 150° C. and provided on at least one surface of the substrate sheet.

7 Claims, No Drawings

HEAT TRANSFER IMAGE-RECEIVING SHEET

This is a continuation of application Ser. No. 07/670,428, filed Mar. 18, 1991, now abandoned.

BACKGROUND OF THE INVENTION

This invention relates to a heat transfer image-receiving sheet, and more particularly to a heat transfer image-receiving sheet capable of producing an image which is excellent in color density, sharpness, fastness, and, in particular, light resistance.

Heretofore, a variety of heat transfer printing methods have been proposed. Among them, a typical one for producing a full-colored image is a method which employs a heat transfer printing sheet comprising a sublimable dye as a coloring agent which is retained in a substrate such as a polyester film, and a heat transfer image-receiving sheet receptive of the sublimable dye, comprising a dye-receiving layer provided on the substrate such as a sheet of paper or a plastic film.

In the above method, heat is applied to the heat transfer printing sheet by a thermal head of a printer, and a large number of dots in three or four colors are transferred to the heat transfer image-receiving sheet in an extremely short heat-application time. An original full-colored image can thus be reproduced in the heat transfer image-receiving sheet.

The image thus obtained is very sharp and clear because a dye is used as a coloring material. Therefore, the heat transfer printing method of this type can provide an excellent half-tone image with continuous gradation, comparable to an image obtained by offset printing or gravure printing. Further, the quality of the image is as high as that of a full-colored photo.

Not only the structure of the heat transfer printing sheet, but also that of the heat transfer image-receiving sheet in which an image is produced are quite important factors in this printing method.

Namely, the dye-receiving layer of the heat transfer image-receiving sheet needs to be highly receptive of the sublimable dye contained in the heat transfer printing sheet, and can firmly retain it.

In the case where the dye-receiving layer is formed from a resin having a high affinity for the sublimable dye, it can be well dyed with the dye. However, in this case, an image produced in the dye-receiving layer will be blurred during storage. In addition, the dye transferred to the dye-receiving layer cannot be firmly retained therein, so that it bleeds out of the dye-receiving layer and tends to stain articles which are brought into contact with the surface of the dye-receiving layer.

The above shortcomings can be eliminated if the dye-receiving layer is prepared from a resin which does not allow the dye transferred from the heat transfer printing sheet to easily migrate to the dye-receiving layer. However, when such a resin is employed, the dye-receiving layer cannot be well dyed with the dye, and cannot produce a sharp image with high density.

SUMMARY OF THE INVENTION

It is therefore an object of the present invention to provide a heat transfer image-receiving sheet for use in the heat transfer printing method which utilizes a sublimable dye, capable of producing a sharp and high-density image which has excellent fastness and, in particular, high light resistance.

The above object of the present invention can be achieved by a heat transfer image-receiving sheet comprising (i) a substrate sheet, and (ii) a dye-receiving layer comprising an ultraviolet-absorbing agent having a melting point of from 50° C. to 150° C. and provided on at least one surface of the substrate sheet.

The ultraviolet-absorbing agent with a melting point of from 50° to 150° C. contained in the dye-receiving layer improves the light resistance of an image produced therein, and also serves as a sensitizer of the sublimable dye transferred to the dye-receiving layer. As a result, a sharp and high-density image with high light resistance can be obtained.

DETAILED DESCRIPTION OF THE INVENTION

The present invention will now be described with reference to specific examples of practice.

The heat transfer image-receiving sheet according to the present invention comprises a substrate sheet, and a dye-receiving layer formed on at least one surface thereof.

Examples of material for the substrate sheet include synthetic paper (polyolefin type, polystyrene type, etc.), high quality paper, art paper, coated paper, cast-coated paper, wallpaper, backing paper, paper impregnated with a synthetic resin or emulsion, paper impregnated with a latex, paper containing a synthetic resin, cardboard, cellulose fiber paper, and synthetic resins such as polyolefin, polyvinylchloride, polyethylene terephthalate, polystyrene, polymethacrylate and polycarbonate. In addition, white opaque films prepared by adding a white pigment or filler to the above-enumerated synthetic resins, and expanded films prepared by expanding the synthetic resins are also usable as the substrate sheet.

Furthermore, laminates prepared by using any of the above-described sheets and films in combination are also usable as the substrate sheet. Typical examples of the laminates are a laminate of cellulose fiber paper and synthetic paper, and a laminate of cellulose fiber paper and a plastic film or sheet.

There is no limitation on the thickness of the substrate sheet. However, the thickness is, in general, in the range of from 10 to 300 μm.

In the case where adhesion between the substrate sheet and the dye-receiving layer provided thereon is not satisfactorily high, it is preferable to subject the surface of the substrate sheet to a primer treatment or corona treatment.

The dye-receiving layer provided on the substrate sheet receives the sublimable dye transferred from the heat transfer printing sheet upon heating, and retains an image produced therein.

Examples of resins usable for preparing the dye-receiving layer include polyolefin resins such as polypropylene, halogenated polymers such as polyvinyl chloride and polyvinylidene chloride, polyvinyl resins such as polyvinyl acetate and polyacrylate, polyester resins such as polyethylene terephthalate and polybutylene terephthalate, polystyrene resins, polyamide resins, copolymeric resins of an olefin such as ethylene or propylene and a vinyl monomer, ionomers, cellulose resins such as cellulose diacetate, and polycarbonate. Of these resins, polyvinyl resins and polyester resins are preferred.

The ultraviolet-absorbing agent for use in the present invention is a low-molecular-weight compound having a melting point of from 50° to 150° C., preferably from 100° to 150° C. In the case where the ultraviolet-absorbing agent has a melting point of lower than 50° C., it tends to bleed over the surface of the dye-receiving layer, causing problems such as blocking. On the other hand, when the melting point exceeds 150° C., the affinity for the dye is drastically reduced, and a high sensitizing effect cannot be expected.

The molecular weight of the ultraviolet-absorbing agent for use in the present invention is 400 or less, preferably 150 to 400. In the case where the ultraviolet-absorbing agent has a molecular weight of more than 400, it cannot fuse sharply against temperatures upon heat transfer printing, and a sufficient sensitizing effect cannot be obtained.

Any conventional ultraviolet-absorbing agents are usable, either singly or in combination, in the present invention as long as their melting points fall between 50° C. and 150° C. Among them, benzophenone compounds, benzotriazole compounds, cyanoacrylate compounds, salicylate compounds and oxalic anilide compounds are preferred.

Of the above-.described ultraviolet-absorbing agents, those having a heat of fusion (ΔH) of from 10 to 300 mJ/mg are more preferable. When the heat of fusion is less than 10 mJ/mg, dots transferred to the dye-receiving layer are blurred while it is more than 300 mJ/mg, the ultraviolet-absorbing agent cannot be easily fused upon heating, so that a sufficient sensitizing effect cannot be obtained.

If all the above-described conditions are taken into consideration, benzophenone compounds having the following formula may be the most preferable ultraviolet-absorbing agents for use in the present invention:

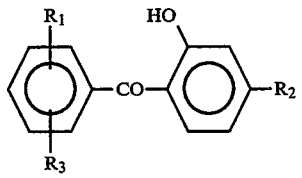

wherein $R_1$ is a hydrogen atom, a hydroxyl group or an alkoxyl group having 1 to 21 carbon atoms, $R_2$ is a hydroxyl group, an alkoxyl group having 1 to 21 carbon atoms, a hydroxyalkoxyl group having 1 to 21 carbon atoms or a phenylalkoxyl group having 1 to 21 carbon atoms, and $R_3$ is a hydrogen atom, a sulfonic acid group or an alkoxyl group having 1 to 21 carbon atoms.

The amount of the ultraviolet-absorbing agent to be incorporated into the dye-receiving layer is preferably 1 to 100 parts by weight, more preferably 20 to 30 parts by weight, per 100 parts by weight of the resin contained in the layer. When the amount of the agent is less than 5 parts by weight, neither satisfactory light resistance nor sensitizing effect can be obtained. When the amount of the agent, on the other hand, exceeds 100 parts by weight, roughening of the dye-receiving layer surface and blurring of formed images are liable to occur.

The term "sensitizing effect" as used herein is defined as an effect which increases the optical reflection density of a printed image, and is different from the term "sensitization" which is commonly used in the field of photography. Namely, if the optical reflection density of an image printed by using a heat transfer image-receiving sheet containing a specific compound is higher than that of an image printed by using a heat transfer image-receiving sheet which does not contain the compound, the compound is considered to have the sensitizing effect.

In order to obtain the sensitizing effect, it seems to be useful to incorporate a plasticizer into the dye-receiving layer. This is because a plasticizer lowers the-glass transition temperature (Tg) of the resin contained in the dye-receiving layer. The plasticizer, however, causes problems such as blocking and blurring because it is liquid at room temperature.

The above shortcomings can be eliminated when a material which is solid at room temperature and is liquefied when heated, such as a wax-like material, is employed. If such a material has a low molecular weight of from about 150 to 400, the melt viscosity of the material is much lower than that of the resin contained in the dye-receiving layer. The material therefore can serve as a carrier of the sublimable dye transferred from the heat transfer printing sheet. As a result, the dye-receiving layer can produce an image with high density.

Furthermore, air exists between the heat transfer layer of the heat transfer sheet and the dye-receiving layer of the heat transfer image-receiving sheet when heat transfer printing is carried out. It is therefore considered that the sublimable dye transferred from the heat transfer layer migrates to the dye-receiving layer via an air layer. For this reason, the speed at which the dye migrates in the air layer determines the entire migration speed of the dye. If a layer which can accelerate migration of the dye is provided on the dye-receiving layer, the dye can smoothly migrate at high speed even if an air layer exists. It is desirable that such a layer also be made from a wax-like material from the viewpoint of storage stability.

However, not all wax-like materials which are solid at room temperature and liquid at an elevated temperature are acceptable. It is necessary that the materials have, in some degree, an affinity for the sublimable dye contained in the heat transfer layer. If they have no affinity at all, no sufficient sensitizing effect can be obtained.

Since the ultraviolet-absorbing agent which fulfills the above-described conditions is used as a sensitizer, the heat transfer image-receiving sheet of the present invention-can produce a high-density image having high storage stability.

The heat transfer image-receiving sheet of the present invention can be prepared in the following manner:

A mixture of the above-described resin, ultraviolet-absorbing agent, and other auxiliary additives such as a cross-linking agent, a hardening agent, a catalyst, a thermo-releasing agent, an antioxidant and a photostabilizer is dissolved in an organic solvent, or dispersed in an organic solvent or water. The solution or dispersion thus obtained is applied onto at least one surface of the substrate sheet by means of gravure printing, screen printing, or reverse roller coating method employing gravure, and then dried to form a dye-receiving layer on the substrate sheet.

Pigments and fillers such as titanium oxide, zinc oxide, kaolin clay, calcium carbonate, fine powder of silica may also be incorporated into the dye-receiving layer. These pigments and fillers increase the whiteness of the dye-receiving layer, so that the sharpness of an image produced in the dye-receiving layer can be enhanced.

There is no limitation on the thickness of the dye-receiving layer, but, in general, it is in the range of from 1 to 50 μm. It is preferable that the dye-receiving layer be a continuous layer. However, a non-continuous layer formed by using an emulsion or dispersion of a resin is also acceptable.

By properly selecting a material for the substrate sheet, the heat transfer image-receiving sheet according to the present invention is utilizable for a variety of purposes, such as cards and transparent sheets in which an image can be thermally produced.

A cushion layer may be interposed between the substrate sheet and the dye-receiving sheet, if necessary. The cushion layer Can absorb noises which are made when printing is conducted. Therefore, when such a layer is provided, an original image can be reproduced in the dye-receiving layer with high fidelity.

Along with the heat transfer image-receiving sheet according to the present invention is used a heat transfer printing sheet which comprises a heat transfer printing layer containing a sublimable dye, provided on a substrate such as a sheet of paper or a polyester film. Any conventional heat transfer printing sheets having such structure are usable.

To conduct heat transfer printing, thermal energy is applied to the heat transfer printing sheet by any one of the conventional heat application methods. For instance, full color printing can be carried out by applying thermal energy in an amount of 5 to 100 mJ/mm$^2$ which can be controlled by changing the printing time, using a printing apparatus such as a thermal printer, for example, "VIDEO PRINTER VY-100" ® manufactured by Hitachi Co., Ltd.

The ultraviolet-absorbing agent with a melting point of from 50° to 150° C. incorporated in the dye-receiving layer of the heat transfer image-receiving sheet according to the present invention not only improves the light resistance of an image produced in the dye-receiving layer but also serves as a sensitizer of the sublimable dye transferred from the heat transfer printing sheet. As a result, the heat transfer image-receiving sheet of the present invention can produce a sharp and high-density image having high light resistance.

This invention will now be explained more specifically with reference to the following Examples, which are presented as illustrative only and are not intended to limit the scope of the invention. Throughout these Examples, quantities expressed in "percent (%)" and "parts" are "weight percent" and "parts by weight", respectively.

EXAMPLE 1

A solution for forming a dye-receiving layer having the following composition was applied by a wire bar onto one surface of a substrate sheet, a sheet of synthetic paper having a thickness of 110 μm manufactured by Oji-Yuka Synthetic Paper Co., Ltd., in an amount of 5.0 g/m$^2$ only dry basis, and then dried and hardened to obtain a heat transfer image-receiving sheet according to the present invention.

| <Composition of Solution for Dye-Receiving Layer> | |
|---|---|
| Polyester resin ("Vylon 600" ®, manufactured by Toyobo K.K., Japan) | 5.4 parts |
| Vinyl chloride/vinyl acetate copolymer ("#1000A" ®, manufactured by Denki Kagaku Kogyo K.K.) | 8.0 parts |
| Amino-modified silicone oil ("KF-393" ®, manufactured by Shin-Etsu Kagaku Kogyo K.K.) | 0.25 part |
| Epoxy-modified silicone oil ("X-22-343" ®, manufactured by Shin-Etsu Kagaku Kogyo K.K.) | 0.25 part |
| Ultraviolet-absorbing agent having the following formula (m.p.: 140° C., m.w.: 214): | 2.7 parts |

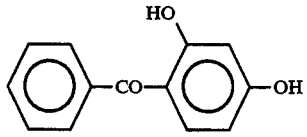

| | |
|---|---|
| Methyl ethyl ketone/toluene (weight ratio: 1:1) | 84.8 parts |

EXAMPLE 2

The procedure of Example 1 was repeated except that the ultraviolet-absorbing agent used in the solution for forming the dye-receiving layer in Example 1 was replaced by an ultraviolet-absorbing agent having the following formula (m.p.: 93° C., m.w.: 256), thereby obtaining a heat transfer image-receiving sheet according to the present invention.

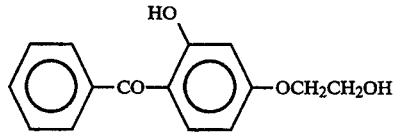

EXAMPLE 3

The procedure of Example 1 was repeated except that the ultraviolet-absorbing agent used in the solution for forming the dye-receiving layer in Example 1 was replaced by an ultraviolet-absorbing agent having the following formula (m.p.: 127° C., m.w.: 160), thereby obtaining a heat transfer image-receiving sheet according to the present invention.

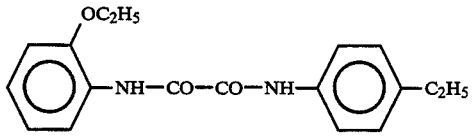

EXAMPLE 4

The procedure of Example 1 was repeated except that the ultraviolet=absorbing agent used in the solution for forming the dye-receiving layer in Example 1 was replaced by an ultraviolet-absorbing agent having the following formula (m.p.: 62° C., m.w.: 284), thereby obtaining a heat transfer image-receiving sheet according to the present invention.

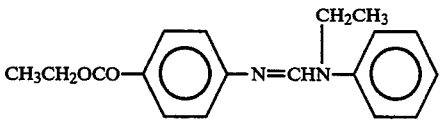

COMPARATIVE EXAMPLE 1

The procedure of Example 1 was repeated except that the ultraviolet-absorbing agent was eliminated from the composition of the solution for forming the dye-receiving layer used in Example 1, thereby obtaining a comparative heat transfer image-receiving sheet.

COMPARATIVE EXAMPLE 2

The procedure of Example 1 was repeated except that the ultraviolet-absorbing agent used in the solution for forming the dye-receiving layer in Example 1 was replaced by an ultraviolet-absorbing agent having the following formula (m.p.: 175° C., m.w.: 260), thereby obtaining a comparative heat transfer image-receiving sheet.

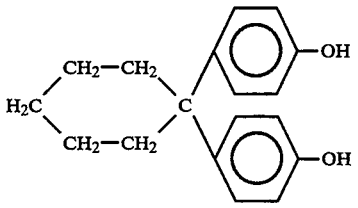

COMPARATIVE EXAMPLE 3

The procedure of Example 1 was repeated except that the ultraviolet-absorbing agent used in the solution for forming the dye-receiving layer in Example 1 was replaced by an ultraviolet-absorbing agent having the following formula (m.p.: 159° C., m.w.: 388), thereby obtaining a comparative heat transfer image-receiving sheet.

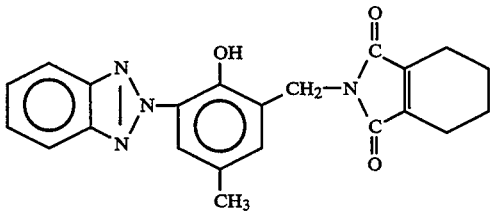

COMPARATIVE EXAMPLE 4

The procedure of Example 1 was repeated except that the ultraviolet-absorbing agent used in the solution for forming the dye-receiving layer in Example 1 was replaced by an ultraviolet-absorbing agent having the following formula (m.p.: 154° C., m.w.: 357.5), thereby obtaining a comparative heat transfer image-receiving sheet.

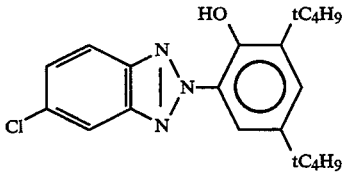

COMPARATIVE EXAMPLE 5

The procedure of Example 1 was repeated except that the ultraviolet-absorbing agent used in the solution for forming the dye-receiving layer in Example 1 was replaced by an ultraviolet-absorbing agent having the following formula (m.p.: 42° C., m.w.: 198), thereby obtaining a comparative heat transfer image-receiving sheet.

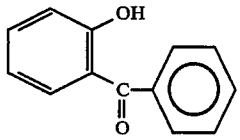

EXAMPLES 5–12

The procedure of Example 1 was repeated except that the ultraviolet-absorbing agent used in the solution for forming the dye-receiving layer in Example 1 was replaced by an ultraviolet-absorbing agent having the following formula (m.p.: 60° C., m.w.: 228) and the amount thereof was changed as shown in Table 1, thereby obtaining heat transfer image-receiving sheets according to the present invention.

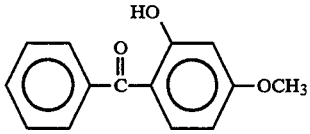

EXAMPLES 13 and 14

The procedure of Example 1 was repeated except that the ultraviolet-absorbing agent used in Example 1 was replaced by the one used in Example 5 and the amount thereof was changed as shown in Table 1, thereby obtaining comparative heat transfer image-receiving sheets.

EVALUATION

The heat transfer image-receiving sheets prepared in Examples 1 to 14 and Comparative Examples 1 to 5 were evaluated in the following manner.

1. Preparation of Heat Transfer Printing Sheet

An ink composition for forming a heat transfer printing layer having the following composition was prepared, applied by a wire bar onto a polyethylene terephthalate film having a thickness of 6 μm with its back surface treated for heat resistance in an amount of 1.0 g/m$^2$ on dry basis, and then dried to obtain a heat transfer printing sheet.

| | |
|---|---|
| C. I. Disperse Blue 24 | 1.0 part |
| Polyvinyl butyral resin | 10.0 parts |
| Methyl ethyl ketone/toluene (weight ratio: 1:1) | 90.0 parts |

2. Printing Tests

Each heat transfer image-receiving sheet was superposed on the above-obtained heat transfer printing sheet so that the dye-receiving layer of the heat transfer image-receiving sheet would face the heat transfer printing layer of the heat transfer printing sheet. Thermal energy was then applied to the back surface of the heat transfer printing sheet by a thermal head under the following conditions:

Electric voltage applied: 12.0 V

Pulse width: 16 msec

Dot density: 6 dots/line

The printed image was evaluated in terms of printing sensitivity, light resistance and blur in dots. The results are shown in Table 1.

Printing Sensitivity

The optical reflection density of each printed image was measured by a MacBeth densitometer RD-914 to evaluate the printing sensitivity. The optical reflection density of the image printed by using the heat transfer image-receiving sheet obtained in Comparative Example 1 was indicated by 1.00, and those of the images printed by using the other image-receiving sheets were indicated by values relative to it.

Light Resistance

The printed image was visually observed. The evaluation standard was as follows:

5: excellent (no fading)

4: good (substantially no fading)

3: poor (faded)

Blur in Dots

The printed image was observed by an optical microscope.

The evaluation standard was as follows:

: no blur

⊙: substantially no blur

Δ: blurred slightly x: blurred (Note)

In Table 1,

A: amount of ultraviolet-absorbing agent,

B: optical reflection density of printed image,

C: light resistance of printed image, and

D: blur in dots.

TABLE 1

| | A (%) | B | C | D |
|---|---|---|---|---|
| Example 1 | 20 | 1.18 | 5 | ⊙ |
| Example 2 | 20 | 1.20 | 5 | ○ |
| Example 3 | 20 | 1.07 | 4 | ○ |
| Example 4 | 20 | 1.14 | 4 | ○ |
| Example 5 | 5 | 1.05 | 4 | ○ |
| Example 6 | 10 | 1.09 | 4 | ○ |
| Example 7 | 20 | 1.15 | 5 | ○ |
| Example 8 | 30 | 1.19 | 5 | ○ |
| Example 9 | 40 | 1.25 | 5 | ○-Δ |
| Example 10 | 50 | 1.34 | 5 | ○-Δ |
| Example 11 | 70 | 1.50 | 5 | ○-Δ |
| Example 12 | 90 | 1.61 | 5 | Δ |
| Comp. Ex. 1 | 0 | 1.00 | 3 | ⊙ |
| Comp. Ex. 2 | 20 | 0.92 | 3 | ⊙ |
| Comp. Ex. 3 | 20 | 0.91 | 3 | ○ |
| Comp. Ex. 4 | 20 | 0.93 | 3 | ○ |
| Comp. Ex. 5 | 20 | 1.25 | 3 | X |
| Example 13 | 0.5 | 1.03 | 4 | ○ |
| Example 14 | 110 | 1.65 | 5 | Δ |

What is claimed is:

1. A heat transfer system comprising a heat transfer sheet and an system used in combination therewith, said image-receiving sheet comprising:

a substrate sheet; and a dye-receiving layer provided on at least one surface of said substrate sheet, said dye-receiving layer comprising a dyeable resin comprising at least vinyl chloride/vinyl acetate copolymer and an ultraviolet-absorbing agent selected from the group consisting of benzotriazole compounds, cyanoacrylate compounds, salicylate compounds and oxalic anilide compounds, said ultraviolet-absorbing agent having a melting point of from 60° C. to 140° C.

2. The heat transfer system according to claim 1, wherein said ultraviolet-absorbing agent has a sensitizing effect.

3. The heat transfer system according to claim 1, which is capable of producing an image with a relative optical reflection density of more than 1.00.

4. The heat transfer system according to claim 1, wherein said ultraviolet-absorbing agent has a heat of fusion (ΔH) of from 10 mJ/mg to 300 mJ/mg.

5. The heat transfer system according to claim 1, wherein said ultraviolet-absorbing agent has a molecular weight of from 150 to 400.

6. A heat transfer system comprising a heat transfer sheet and an system used in combination therewith, said system comprising:

a substrate sheet; and a dye-receiving layer comprising a dyeable resin comprising at least vinyl chloride/vinyl acetate copolymer and an ultraviolet-absorbing agent having a melting point of from 50° C. to 150° C., said ultraviolet-absorbing agent consisting of benzophenone compounds represented by the following formula:

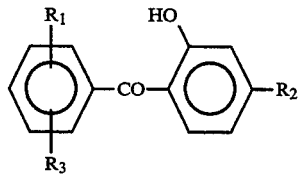

wherein $R_1$ is a hydrogen atom, a hydroxyl group or an alkoxyl group having 1 to 21 carbon atoms, $R_2$ is a hydroxyl group, an alkoxyl group having 1 to 21 carbon atoms, a hydroxyalkoxyl group having 1 to 21 carbon atoms or a phenylalkoxyl group having 1 to 21 carbon atoms, and $R_3$ is a hydrogen atom, a sulfonic acid group or an alkoxyl group having 1 to 21 carbon atoms.

7. The heat transfer system according to claim 6, wherein said benzophenone compound is selected from the group consisting of the following compounds (i), (ii) and (iii):

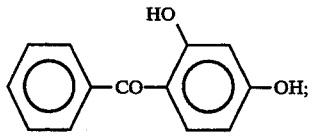

(i)

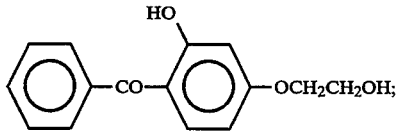

(ii)

and

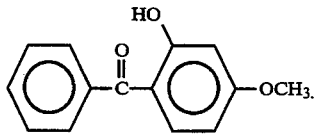

(iii)

* * * * *